US011390500B2

(12) United States Patent
Kicher et al.

(10) Patent No.: US 11,390,500 B2
(45) Date of Patent: Jul. 19, 2022

(54) DRIVE DRUM FOR OVERHEAD DOORS

(71) Applicant: ENGINEERED HARDWARE, LLC, Mentor, OH (US)

(72) Inventors: Paul T. Kicher, Waite Hill, OH (US); Thomas P. Kicher, Willoughby Hills, OH (US)

(73) Assignee: Engineered Hardware, LLC, Mentor, OH (US)

( * ) Notice: Subject to any disclaimer, the term of this patent is extended or adjusted under 35 U.S.C. 154(b) by 96 days.

(21) Appl. No.: 16/856,090

(22) Filed: Apr. 23, 2020

(65) Prior Publication Data

US 2020/0339395 A1 Oct. 29, 2020

Related U.S. Application Data

(60) Provisional application No. 62/936,815, filed on Nov. 18, 2019, provisional application No. 62/839,252, filed on Apr. 26, 2019.

(51) Int. Cl.
*B66D 1/60* (2006.01)
*E05F 15/686* (2015.01)
(Continued)

(52) U.S. Cl.
CPC ..... *B66D 1/60* (2013.01); *B65H 75/4486* (2013.01); *B66D 1/36* (2013.01); *E05F 15/686* (2015.01); *E05Y 2201/654* (2013.01); *E05Y 2900/106* (2013.01); *E06B 3/485* (2013.01); *E06B 3/70* (2013.01); *E06B 2003/7044* (2013.01)

(58) Field of Classification Search
CPC ..... B66D 1/36; B66D 1/60; E05D 13/1261; E05D 13/1215; E05D 15/24; E05D 15/686; E05Y 2201/664; E05Y 2201/654; E05Y 2201/618; E05Y 2201/416; E05Y 2201/478; E05Y 2900/106; Y10T 16/641;
(Continued)

(56) References Cited

U.S. PATENT DOCUMENTS 1,179,309 A * 4/1916 Henshaw ..... G03D 13/046 242/602.1
1,530,762 A 3/1925 Dautrick
(Continued)

FOREIGN PATENT DOCUMENTS

| | | |
|---|---|---|
| CN | 104310252 A | 1/2015 |
| DE | 1425058 A1 | 2/1969 |
| EP | 210086 A1 | 1/1987 |

OTHER PUBLICATIONS

PCT/US2020/029428 International Search Report and Written Opinion dated Aug. 25, 2020, 12 pages.

*Primary Examiner* — Michael E Gallion
(74) *Attorney, Agent, or Firm* — Hahn Loeser & Parks LLP

(57) ABSTRACT

The present disclosure is directed to overhead door assemblies and operating systems. Disclosed herein is a drive drum that is compatible across a variety of overhead door types, including, for example, standard lift doors, vertical lift doors, and high lift doors. The drive drum of the present disclosure comprises a first cable groove section and a second cable groove section, opposite the first cable groove section, wherein at least one of the first cable groove section or the second cable groove section is in a non-linear graduated arrangement.

19 Claims, 13 Drawing Sheets

(51) Int. Cl.

| | |
|---|---|
| ***B65H 75/44*** | (2006.01) |
| ***B66D 1/36*** | (2006.01) |
| *E06B 3/70* | (2006.01) |
| *E06B 3/48* | (2006.01) |

(58) Field of Classification Search
CPC ... E06B 9/62; E06B 3/485; E06B 3/70; E06B 2003/7044; B65H 75/4486
See application file for complete search history.

(56) References Cited

U.S. PATENT DOCUMENTS 1,597,028 A 8/1926 Feidt et al.
1,874,077 A * 8/1932 Anderson ..... E06B 9/62 16/400
1,897,391 A 2/1933 Kelly
2,007,552 A * 7/1935 Vetterlein ..... E06B 3/925 160/193
2,059,585 A 11/1936 Kelly
2,314,015 A * 3/1943 Parsons ..... E05D 13/1261 16/198
2,327,778 A 8/1943 Ferris et al.
2,330,006 A 9/1943 Odenthal
2,370,029 A * 2/1945 Gayle ..... B66D 1/7442 74/89.2
2,533,423 A 12/1950 Bunch
2,534,525 A 12/1950 Molloy
3,165,143 A 1/1965 Jackwig
3,212,727 A 10/1965 Fonden et al.
3,240,484 A 3/1966 Klamp
3,349,516 A 10/1967 Armstrong
3,468,060 A 9/1969 Mursinna
3,499,478 A * 3/1970 Schneider ..... E05D 15/262 160/207
3,537,503 A 11/1970 Simmonds
3,615,065 A * 10/1971 Elliott ..... E05D 13/1261 242/375.1
3,853,205 A * 12/1974 Gindroz, Jr. ..... B66B 1/02 187/260
4,102,382 A 7/1978 Vesbach
4,417,418 A 11/1983 Warning
4,642,845 A 2/1987 Marshik
4,683,677 A 8/1987 Jurgensen
4,882,806 A * 11/1989 Davis ..... E05D 13/1261 16/198
4,891,908 A 1/1990 Aquilina
4,941,320 A 7/1990 Kersten et al.
5,040,332 A 8/1991 Aquilina
5,054,162 A * 10/1991 Rogers ..... E05D 13/1276 16/198
5,103,890 A * 4/1992 Cloutier ..... E05D 13/145 160/190
5,239,777 A * 8/1993 Husselton ..... E05D 13/1261 160/191
5,259,433 A * 11/1993 Cloutier ..... E05D 13/14 160/190
5,280,818 A 1/1994 Ubelhart
5,365,636 A 11/1994 Jensen
5,482,103 A 1/1996 Burgess et al.
5,803,149 A * 9/1998 Halley ..... E05F 15/686 160/201
5,829,736 A 11/1998 Harken
6,134,835 A * 10/2000 Krupke ..... E05D 13/1261 160/191
6,561,256 B2 5/2003 Mullet
6,735,820 B1 5/2004 Teutsch
6,983,785 B2 1/2006 Altimore
7,343,958 B1 * 3/2008 East ..... E05D 13/1261 16/401
7,537,042 B2 5/2009 Altimore
8,025,090 B2 * 9/2011 Kicher ..... E05D 13/12 160/191
9,127,492 B2 * 9/2015 Friesen ..... E05D 13/1261
2002/0157797 A1 * 10/2002 Mullet ..... E05F 15/686 160/201
2003/0209333 A1 11/2003 Olmsted
2005/0082015 A1 * 4/2005 Altimore ..... E05D 13/1238 160/133
2006/0137138 A1 * 6/2006 Mullet ..... E05D 13/1261 16/197
2007/0137801 A1 * 6/2007 Kicher ..... E05D 13/1215 160/191
2009/0291793 A1 11/2009 Marchesseault
2011/0308744 A1 * 12/2011 Kicher ..... E05D 13/12 160/191
2017/0008158 A1 * 1/2017 Hammon ..... E05F 11/00
2020/0018110 A1 * 1/2020 Lindley ..... E05F 15/686

* cited by examiner

DRIVE DRUM FOR OVERHEAD DOORS

This patent application claims priority to and the benefit of U.S. Provisional Application No. 62/839,252, filed Apr. 26, 2019, and U.S. Provisional Application No. 62/936,815, filed Nov. 18, 2019, which are all incorporated herein by reference.

BACKGROUND

This disclosure relates to overhead doors and overhead door operation. More specifically, the present disclosure relates to a drive drum for use in combination with a variety of overhead doors and door systems.

Overhead doors, such as sectional doors, secure or provide access to a space or building by operating in a vertical direction between an open and a closed position to provide or prevent access through an opening. Numerous overhead door designs have been implemented for a variety of conditions. Examples of overhead door designs include standard lift doors, vertical lift doors, and high lift doors. Each type of overhead door design comes with its own benefits and differences.

A standard lift door is a type of overhead door that might be found in residential construction such as, for example, in a residential garage. Because residential construction typically does not have high overhead clearances a standard lift door operates along two laterally spaced tracks positioned to opposing sides of an opening that transition horizontally above the door opening. The tracks rise vertically from the ground, includes a transition section, and extend into a horizontal top section. The door travels along the track by way of rollers. When in a closed position the standard lift door is positioned along the vertical section at the opening. Independent of any separate locking mechanisms or driving mechanisms, gravity maintains the door in the closed position. When in an opened position the standard lift door is positioned fully or substantially on the horizontal top section where most of the weight of the door is supported by the rails in the horizontal top section. As used herein substantially on the horizontal top section may include at least one panel positioned on the transition section. As will be discussed in greater detail below a counter-balancing system, or energy storage device, may be relied on to assist with operation of the door.

A vertical lift door is a type of overhead door that might be found in a commercial facility such as, for example, a warehouse facility with high ceilings at the opening. With high overhead clearances a vertical lift door rises its full height in a vertical direction. Like a standard lift door, a vertical lift door operates along two laterally spaced tracks positioned to opposing sides of an opening. However, unlike the standard lift door, the vertical lift door does not transition through a transition section from a vertical section to a horizontal section. Instead, the vertical lift door is maintained in substantially a vertical position in both the open position and the closed position. The vertical lift door is maintained in the open position by way of a counter-balancing system. The vertical lift door is maintained in the closed position under the weight of the door.

A high lift door is also a type of overhead door that might be found in a commercial facility or in a residential arrangement having higher overhead clearance (comparatively to the standard lift door). Like the standard lift door and the vertical lift door, a high lift door operates along two laterally spaced tracks positioned to opposing sides of an opening. A high lift door is a door that has a higher vertical lift than a standard lift door. The high lift door transitions from a vertical orientation, when a closed position, to an orientation that is oblique to the vertical orientation, when in an open position. When in the open position, a section of the high lift door may be in a horizontal position or a position between the horizontal position and the vertical position. One panel of the high lift door may be maintained in a substantially vertical position, above the door opening, while another panel of the high lift door may be maintained at an angle oblique to the vertical direction, when in the opened position. High lift doors are provided to maintain as much overhead clearance as possible. A high lift door may operate along a path that follows a ceiling or may transition away from a vertical wall as it is rises. A high lift door includes a transition section, however, the transition section of a high lift door is much greater, or has a larger sweeping angle, than a standard lift door. Due to the higher lift and the larger sweeping angle a high lift door will not travel as far, or at all, in a horizontal direction, as compared to a standard lift door.

As discussed above, each type of overhead door possesses distinguishing arrangements that are utilized for different purposes. Moreover, additional variations of the above types of doors may vary across each type of door such that the above types are used as examples to illustrate families of doors across each type. With respect to these multiple variations, the operation and construction of each type of overhead door is also different. Some common features that may be found in each type of door may include the above-mentioned rails (albeit their arrangement is different), a counter-balancing system, a rotating shaft, a door drum secured to the door by way of a cable for pulling the door, and a drive drum for assisting door operation between the rotating shaft and the counter-balancing system. However, these features interact and are constructed differently between each type of overhead door. These features are listed herein as examples of what a typical overhead door may include. Overhead doors of other arrangements or construction are also contemplated herein.

As noted above, each type of overhead door operates in different arrangements (e.g. fully vertical, with transition sections, vertically and horizontally, etc.). The impact of these different operating arrangements require significant differences in the construction of the counter-balancing systems, the rotating shafts, the door drums, and the drive drums. Specifically, the forces applied between each of these components, by way of each of these different arrangements, vary significantly. Additionally, it is a combination of these components which provide a user ease in operating an overhead door. By example, the counter-balancing system is provided to overcome the weight of the door, thereby, providing the user ease in lifting the door from the closed position to the opened position. However, at the same time, the counter-balancing system, in combination with the drive drum, is relied on to maintain control of the operation of overhead door, such as for example when moving from a vertical section to a horizontal section where the weight of the door may additionally transition vertically to horizontally. This coordination between the counter-balancing system is further complicated when components may be added to an overhead door such as windows. These additional components may add weight to an already unbalanced operation of an overhead door. It is through each of these components that the operation of the overhead door must be maintained in a continuous and balanced operation through vertical sections, transition sections, and horizontal sections, as applicable, with the least amount of effort required from a user to operate or control the movement of the door.

Simply stated, the operation of the door requires an irregular energy output, or non-linearity of energy, depending upon the overhead door position, the overhead door arrangement, and/or the overhead door construction. This degree of complexity between the different types of overhead doors increases the manufacture and maintenance costs for overhead doors. These complexities also have the potential for decreasing the life of operation of the overhead doors.

With the exception of some extension spring counter-balancing systems, counter-balancing is achieved by creating a counter-torque that is nearly equal but opposite to the torque created by the door's attachment to the shaft by way of the door drum(s). In the past, door drums have attempted to address the behavior of the door's motion. A door drum, however, has not been designed to accommodate movement of the door, the non-linearity of the forces on the door, and the non-linearity of a counter-balancing system.

In view of this, what is needed are components, and more specifically drive drums, that are interchangeable and compatible between the different overhead door types and their respective door drums. Also, what is needed are drive drums that accommodate the non-linearity of energy exhibited during use of the overhead door due to the door travel but that also accommodate the non-linearity of the energy applied through various counter-balancing system, or energy storage device, as will be described in various examples of the present disclosure.

SUMMARY

The present disclosure relates to overhead doors and a drive drum that is interchangeable between various types of overhead doors and various types of overhead door counter-balancing systems. The present disclosure also relates to an overhead door system having a drive drum that is interchangeable between various types of overhead doors and is also compatible with a variety of counter-balancing systems, or energy storage devices, such as, for example, gas springs.

In one example of a drive drum of the present disclosure the drive drum comprises a cable groove having a first cable groove end and a second cable groove end where the cable groove winds about a perimeter of the drive drum helically in a direction of an axis of the drive drum from the first cable groove end to the second cable groove end. The drive drum further comprises a drive drum diameter where the drive drum diameter at the first cable groove end and the second cable groove end are less than the drive drum diameter at an intermediate cable groove position between the first cable groove end and the second cable groove end. In some examples, the diameter of the drive drum at the first cable groove end is less than the diameter of the drive drum at the second cable groove end. In some examples, the cable groove is graduated along the perimeter of the drive drum in the direction of the axis of the drive drum. The graduated perimeter may be additionally non-linear. In such an example, the non-linear graduated perimeter may continuously increase from the first cable groove end to an intermediate cable groove position. In some examples, the non-linear graduated perimeter may additionally, or alternatively, continuously increase from the second cable groove end to the intermediate cable groove position. In one specific example, the non-linear graduated perimeter continuously increases from the first cable groove end to the intermediate cable groove position and the non-linear graduated perimeter continuously increases from the second cable groove end to the intermediate cable groove position.

In some examples the drive drum may further comprise a hub. The first cable groove end may extend onto the hub. The hub may further comprise a set screw extending through at least one side of the hub for anchoring the drive drum to a shaft. The drive drum may further comprise a bore having a bore diameter which mates with an exterior diameter of the shaft. A counterbore may additionally be provided in the drive drum where the counterbore has a diameter greater than the bore diameter. The set screw may additionally extend through the counterbore. In some examples, the drive drum is interchangeable between each of a standard lift door, a vertical lift door, and a high lift door.

In an example of an operating assembly for an overhead door the operating assembly comprises a drive drum. The drive drum may operate between a rotating shaft, for controlling movement of an overhead door, and a counter-balance system, to assist with movement of the overhead door. The drive drum may further comprise two opposing graduated sections of a cable groove extending about the perimeter of the drive drum. The graduations of the cable groove extend in a direction of an axis of the drive drum. The graduation of the first graduated section of the two opposing graduated sections increases toward the second graduated section of the two opposing graduated sections. Further, at least one of the two opposing graduated sections may be additionally non-linear, such that it is a non-linear graduated section.

In some examples the first graduated section and the second graduated section may be defined by at least three consecutive graduations extending in a direction parallel to the axis of the drive drum. In another example, the first graduation section and the second graduated section may be defined by at least four consecutive graduations extending in a direction parallel to the axis of the drive drum. In some examples the two opposing graduated sections may be adjacent. Further, the two opposing graduated sections may meet at the largest drive drum diameter. In some examples the two opposing graduated sections may be separated by an intermediate section. The intermediate section may comprise the largest drive drum diameter. In some examples the dimension between each respective graduation, or the rise of each respective graduation, of the non-linear graduated section may increase toward the opposing graduated section. In another example, the dimension between each respective graduation, or the rise of each respective graduation, of the non-linear graduated section, may decrease toward the opposing graduated section.

In an example of an operating assembly for an overhead door the drive drum may further comprise a hub. The hub may include one or more set screws extending therethrough for anchoring the drive drum to the shaft. The hub may additionally comprise a bore having a bore diameter where the bore diameter mates with an exterior diameter of the shaft. The hub may additionally comprise a counterbore through which the set screw extends wherein the counterbore diameter is greater than the bore diameter.

In some examples a cable may operate on different portions of the drive drum based upon the type of or orientation of the overhead door. In some examples the cable may operate within the cable groove on the first graduated section only, between the open position and the closed position of the overhead door. In some examples the cable may operate within the cable groove on both the first graduated section and the second graduated section, between the open position and the closed position of the overhead door. In some examples the cable may operate within the cable groove less than 75% of both the first graduated section and the second graduated section, between the open position and the closed position. In some examples the cable may operate within the cable groove less than 75% of at least one of the first graduated section and the second graduated section, between the open position and the closed position. In some examples the cable may operate within the cable groove less than 50% of both the first graduated section and the second graduated section, between the open position and the closed position. In some examples the cable may operate within the cable groove less than 50% of at least one of the first graduated section and the second graduated section, between the open position and the closed position. In some examples the cable may operate within the cable groove less than 25% of both the first graduated section and the second graduated section, between the open position and the closed position. In some examples the cable may operate within the cable groove less than 25% of at least one of the first graduated section and the second graduated section, between the open position and the closed position. In some examples the cable may operate within the cable groove 100% of at least one of the first graduated section and the second graduated section, between the open position and the closed position. In some examples the cable may operate within the cable groove 100% of the second graduated section, between the open position and the closed position. The foregoing and other objects, features, and advantages of the examples will be apparent from the following more detailed descriptions of particular examples as illustrated in the accompanying drawings wherein like reference numbers represent like parts of the examples.

BRIEF DESCRIPTION OF THE DRAWINGS

Reference is made to the accompanying drawings in which particular examples and further benefits of the examples are illustrated as described in more detail in the description below, in which.

DETAILED DESCRIPTION

Figure 1:
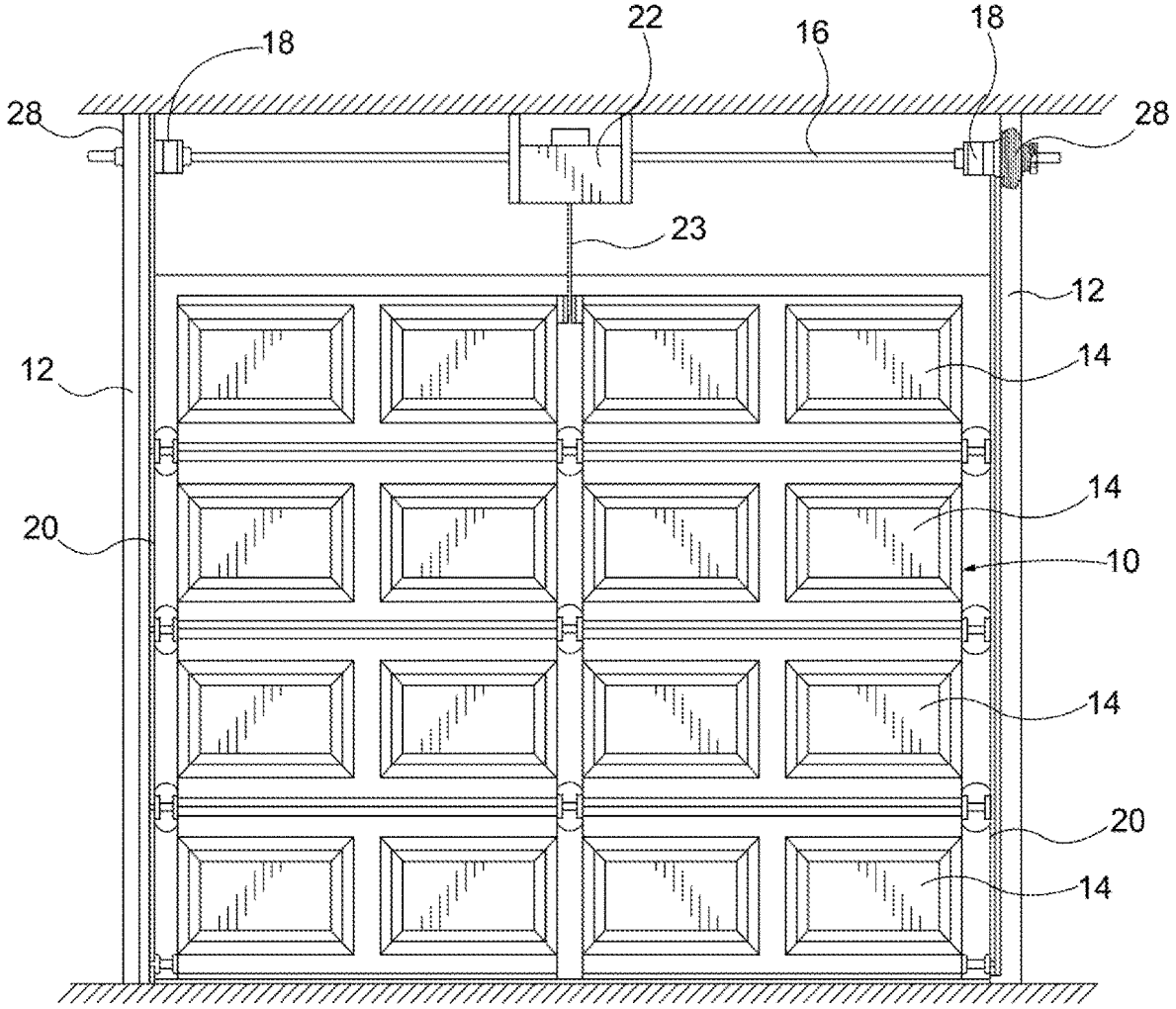
FIG. 1 is a rear elevation view of a door operating assembly, in accordance with an example of the disclosure.

The present disclosure is directed to overhead door assemblies and operating systems. Specifically, disclosed herein is a drive drum that is compatible across a variety of overhead door types or families of overhead door types, including, for example, standard lift doors, vertical lift doors, and high lift doors. Also disclosed herein is a drive drum that is compatible with a variety of counter-balancing systems, or energy storage devices, relied on to counteract the weight of the door for efficient and balanced operation of the door. The drive drum of the present disclosure not only accommodates the non-linearity of energy produced from the weight of an overhead door, transitioning between opened and closed positions, but also accommodates the non-linearity of energy resulting from respective counter-balancing systems, or energy storage devices, relied on to assist with operation of the overhead doors.

Examples of counter-balancing systems, or energy storage devices, include torsion springs, extension springs, and gas springs. One example of a torsion spring may be found in U.S. Pat. No. 7,343,958 to East et. al., the contents of which are incorporated herein by reference in their entirety for this purpose. One example of extension springs may be found in U.S. Pat. No. 6,561,256 to Mullet, the contents of which are incorporated herein by reference in their entirety for this purpose. Examples of gas springs may be found in U.S. Pat. Nos. 6,983,785 and 7,537,042 to Altimore and U.S. Pat. No. 8,025,090 to Kicher, the contents of all of which are incorporated herein by reference in their entirety for this purpose. Counter-balancing systems, or energy storage devices, are provided to produce mechanical assistance to the operation of an overhead door. In particular, when an overhead door is in the closed position and is oriented vertically a significant amount of force would be required to overcome the weight of the door to begin moving the door to an open position. Without mechanical assistance, this endeavor on large overhead doors would be extremely difficult on the user and door equipment. Therefore, a counter-balance, or energy storage device, is provided to offset the weight of the door to assist with driving the door from the closed position to an open position. However, as noted above, the weight of the door may transition through various orientations (e.g. vertical sections, transition sections, horizontal sections, etc.) before reaching the open position. The weight of the door is, therefore, not consistent through the entire operation of the door. This must be compensated for in the counter-balancing system, or energy storage device.

Generally, springs are relied on to provide mechanical assistance to move an overhead door between the closed position and the open position with examples of springs including torsion springs, extension springs, and gas springs. The springs alone, however, do not compensate for the weight of the door as it transitions through the various door orientations (e.g. vertical sections, transition sections, horizontal sections, etc.). The springs additionally do not compensate for sections of an overhead door that may have components heavier than the other sections of an overhead door such as, for example, window sections. Therefore, the varying forces resulting from these various configurations must be compensated for elsewhere. Additionally, just as the spring assists with lifting the weight of the door from the closed position to an open position the spring must additionally assist with dampening, or slowing, the movement of the door when the door moves from the open position to the closed position. Moreover, mechanical assistance of the counter-balancing system must be done in a balanced manner, otherwise, other door components may incur increased wear and/or the door may fail due to inconsistent operation at different opening stages.

Figure 2:
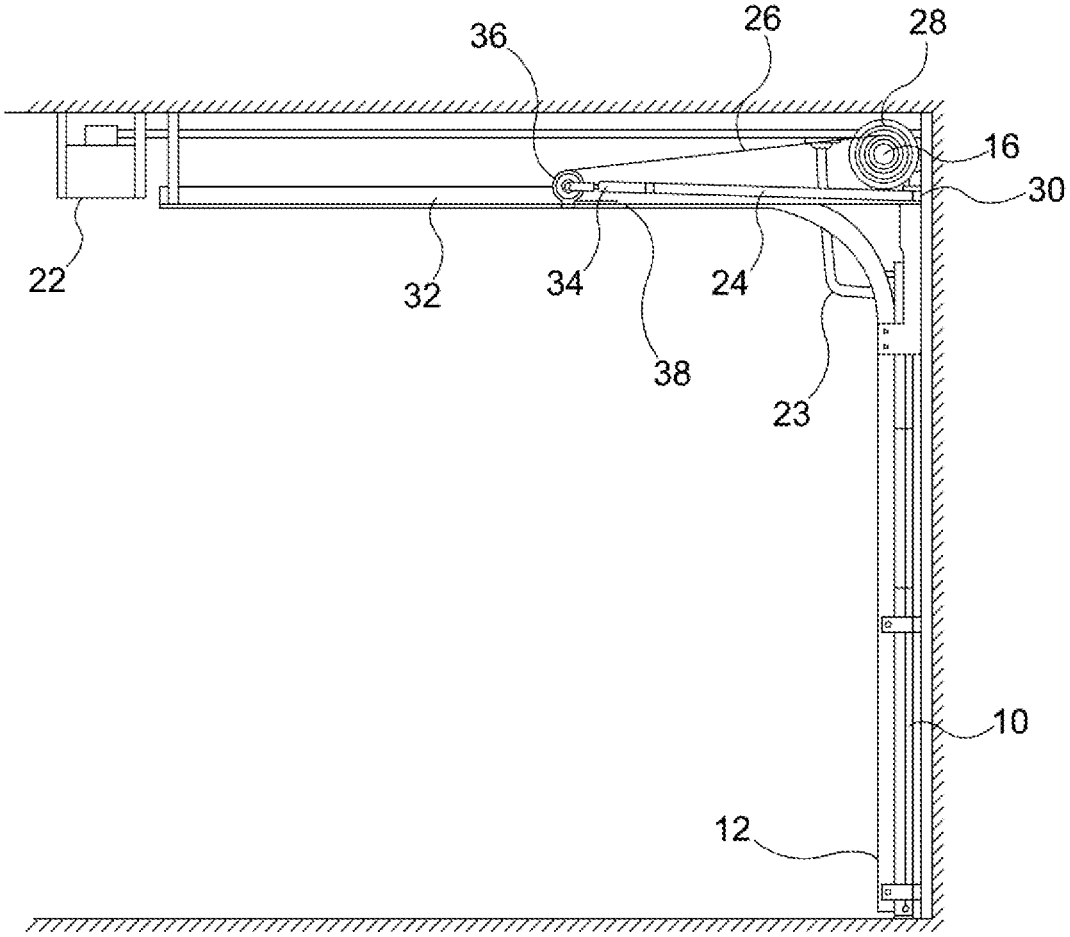
FIG. 2 is a side view of a door operating assembly, in accordance with an example of the disclosure.

Turning to the figures, FIGS. 1-2 illustrate an overhead door 10 arranged to be raised and lowered along a pair of tracks 12. The door 10 includes a plurality of hinged panels 14. In the example of FIGS. 1-2, a standard lift door is illustrated. Generally, and as illustrated by the standard lift door of FIGS. 1-2, overhead door construction includes a shaft 16, door drum(s) 18, and a drive drum 28. A bearing plate may additionally be positioned between the door drum and the drive drum on the shaft. Specifically, the drive drum 28 is secured to a first end of the shaft 16 and may abut the bearing plate for securing the assembly to a wall. Opposite the drive drum 28, relative to the bearing plate, is a door drum 18 which is additionally secured to the shaft 16. In some examples, a second door drum 18 is secured to the shaft 16 at the opposing end of the shaft thereby having a door drum 18 positioned at each lateral side of the door on the length of the shaft 16. A respective cable 20 extends and is secured between each door drum 18 and the door 10, such as to the base of the door 10. As the shaft 16 rotates, the cable 20 either winds about the door drum (when the door is being raised) or unwinds from the door drum 18 (when the door is being lowered) to drive or release the door 10 between the open position and the closed position, respectively. The force driving, or rotating, the shaft 16 and the door drum 18 is driven through the drive drum 28 by way of the counter-balancing system 24, or energy storage device. The door 10 further comprises rollers which are guided along the opposing tracks 12 to maintain the path of the door 10 relative the opposing tracks 12.

Figure 3:
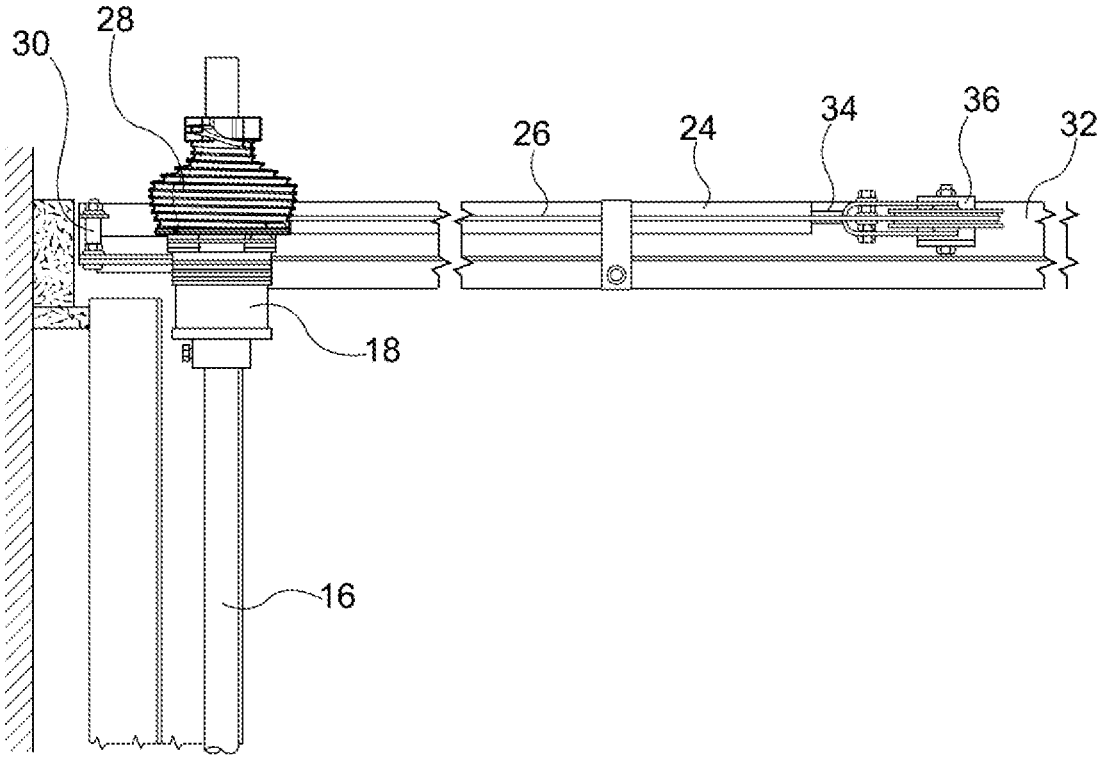
FIG. 3 is a detailed top view of a door operating assembly, in accordance with an example of the disclosure.

In one example as illustrated by FIGS. 2-3, the counter-balancing system, or energy storage device, is a gas spring 24. The gas spring arrangement may be one that is described in U.S. Pat. Nos. 6,983,785 and 7,537,042 to Altimore and U.S. Pat. No. 8,025,090 to Kicher, the contents of all of which are incorporated herein by reference in their entirety for this purpose. The gas spring 24 is moveably connected by way of a spring cable 26 to the drive drum 28. The gas spring 24 is further secured to one of the rails 32 of the door assembly. In this example, the gas spring 24 is secured to a vertical rail of the door assembly. Instead of being secured to a rail, the gas spring may additionally, or alternatively, be secured to the building structure, or component thereof, on which the overhead door operates. The spring cable 26 may extend from the gas spring 24 to the drive drum 28 through a pulley system 36 and ultimately wraps the drive drum 28 to drive or control the rotation of the drive drum 28, the shaft 16, and the door drum 18. By controlling the rotation of the drive drum 28, the shaft 16, and the door drum 18, the requisite mechanical assistance needed to operate the overhead door is ultimately provided. It is appreciated herein that the counter-balancing system may be used in combination with a door lifting device 22 (e.g. door opener, electric motor, etc.) such that the counter-balancing system reduces the load on the door lifting device 22, or door opener. The counter-balancing system may additionally, or alternatively, allow the overhead door 10 to be operated manually, independent of any door lifting device 22, or door opener.

More specifically, the gas spring 24 is coupled to the shaft 16 through a spring cable 26 and a drive drum 28. The gas spring 24 is fixed on a first end 30 and slideably coupled to a rail 32 on a second end 34. A pulley wheel 36 is attached to the slideable end 34 of the gas spring 24 to engage the gas spring 24 with the rail 32. The spring cable 26 is secured to the drive drum 28 at one end. The spring cable 26 extends from the drive drum 28, around the pulley wheel 36, and is secured to a fix point 38 on the rail. Additionally, or alternatively, it may be secured to a point affixed to the spring. The spring may have additional pulleys for increased mechanical advantage. The gas spring 24 is arranged such that as the door is lowered, the spring cable 26 winds around the drive drum 28, and the spring compresses and pressurizes to store energy. As the door 10 is raised, the spring cable 26 unwinds from the drive drum 28 and the gas spring 24 extends and releases stored energy. As noted above, a lifting device 22 may additionally be provided. When the lifting device 22 is actuated or a user begins to raise the door 10, the shaft 16 begins to rotate, which unwinds the spring cable 26 from the drive drum 28. This movement allows the gas spring 24 to extend and release stored energy. The release of this energy assists the shaft 16 in rotating, thus assisting in lifting the door 10. Thereby, when the door 10 is in an open or raised position, the spring cable 26 is unwound from the drive drum 28 and the gas spring 24 is extended. As the lifting device 22 is actuated or a user begins to lower the door 10, the shaft 16 begins to rotate in the opposite direction, which winds the spring cable 26 on the drive drum 28. This movement compresses the gas spring 24, which stores energy. This storing of energy resists the rotation of the shaft 16, thereby slowing movement of the door 10 as it is lowered.

The drive drum arrangement used in combination with a gas spring of the present example is an improvement over the prior patents noted above by providing an efficient and balanced overhead door travel across the families of each of a standard lift door, a vertical lift door, and a high lift door under a single component (e.g. drive drum) or manufacture of a drive drum. Additionally, the drive drum arrangement used in combination with a gas spring of the present example is an improvement over the prior patents by compensating for both the non-linearity of energy resulting from the door travel as well as the non-linearity of the counter-balancing system of the gas spring for each type of doors (referred to herein as a second-order non-linearity).

Figure 4:
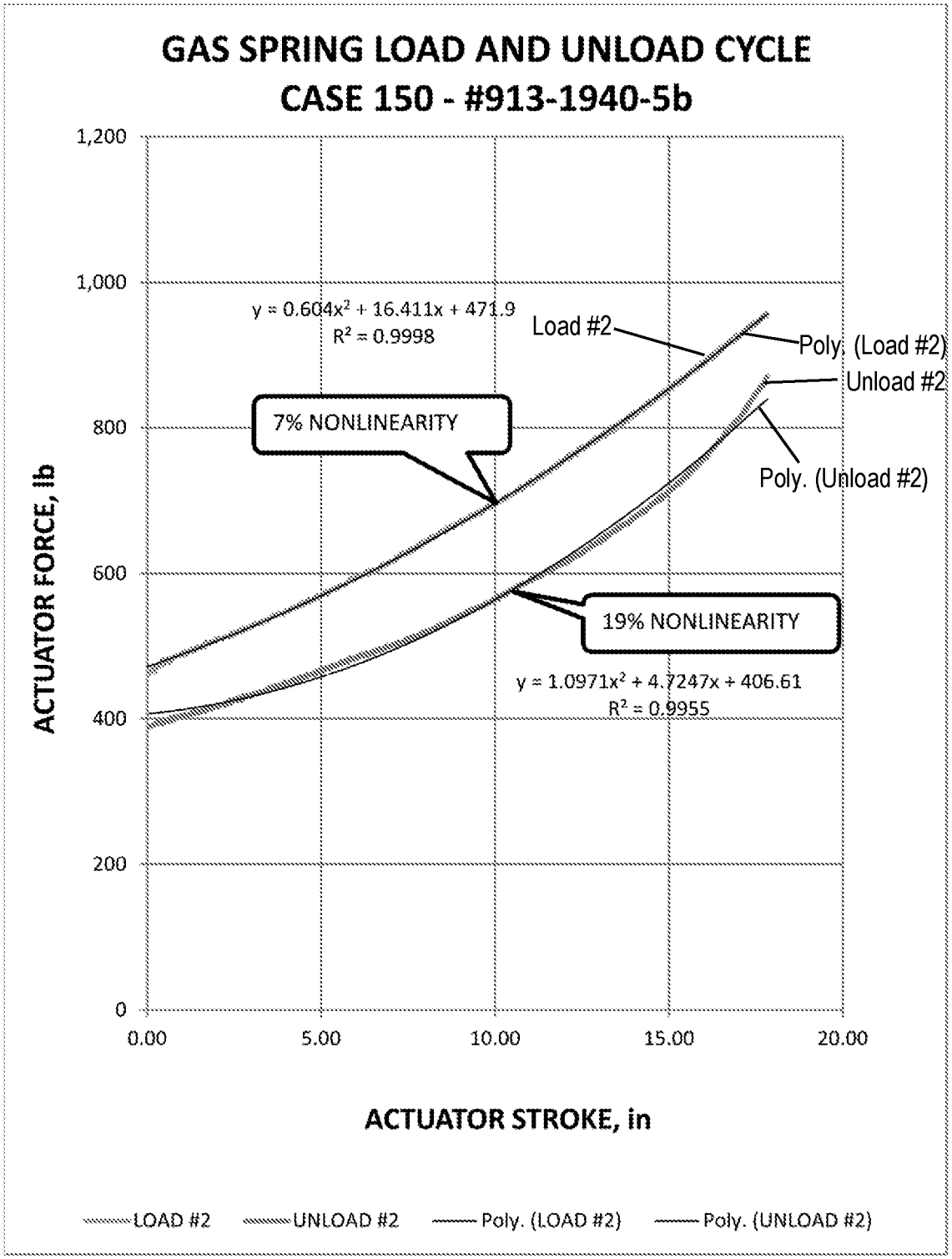
FIG. 4 is a graphical representation of the force versus displacement of a gas spring.

The stroke of the gas spring provides the operable range of motion for the overhead door by way of any intermediate pulley system 36, the drive drum 28, the shaft 16, and the door drum 18. The amount of resistance or force produced by the gas spring 24, however, is not provided in a linear manner over the length of the stroke. When the stroke of the gas spring 24 is at its least the greatest amount of energy is stored in the gas spring, such as when the door 10 is lowered in the example above. In the present examples, this stored energy is what provides the mechanical assistance to overcome the weight of the door 10 when the door 10 is being lifted from a closed position to an open position. In contrast, when the stroke of the gas spring 24 is at its greatest the energy stored in the gas spring 24 is parabolically reduced and the amount of driving force being exerted by the gas spring 24 is additionally reduced. FIG. 4 is a graphical representation of a force versus displacement of an embodiment of the gas spring. The amount of force being exerted between the short stroke and the long stroke of a gas spring 24, however, is a second-order non-linearity which must be compensated for by way of the drive drum 28. Additionally, or alternatively, the weight of the door 10, which is being overcome by way of the mechanical assistance imparted by the gas spring 24, is also a trigonometric non-linearity and varies greatly depending upon the door position as well as the type of overhead door, as noted above. The combination of these non-linear relationships, such as the non-linear gas spring as well as the non-linear behavior of the door, may be referred to herein as a second order non-linearity. Therefore, this must also be compensated for by way of the drive drum 28. If these second-order non-linearity forces are not balanced through the drive drum 28, a door 10 may not raise fully, may generate too much momentum, may raise too quickly, may not stop, may be driven in an erratic manner, and/or the like as it travels between the open and the closed positions. Such erratic behavior increases stresses on the overhead door components, such as the cables, and may create pre-mature failure of the overhead door components as well as creating an unsafe condition.

Figure 5:
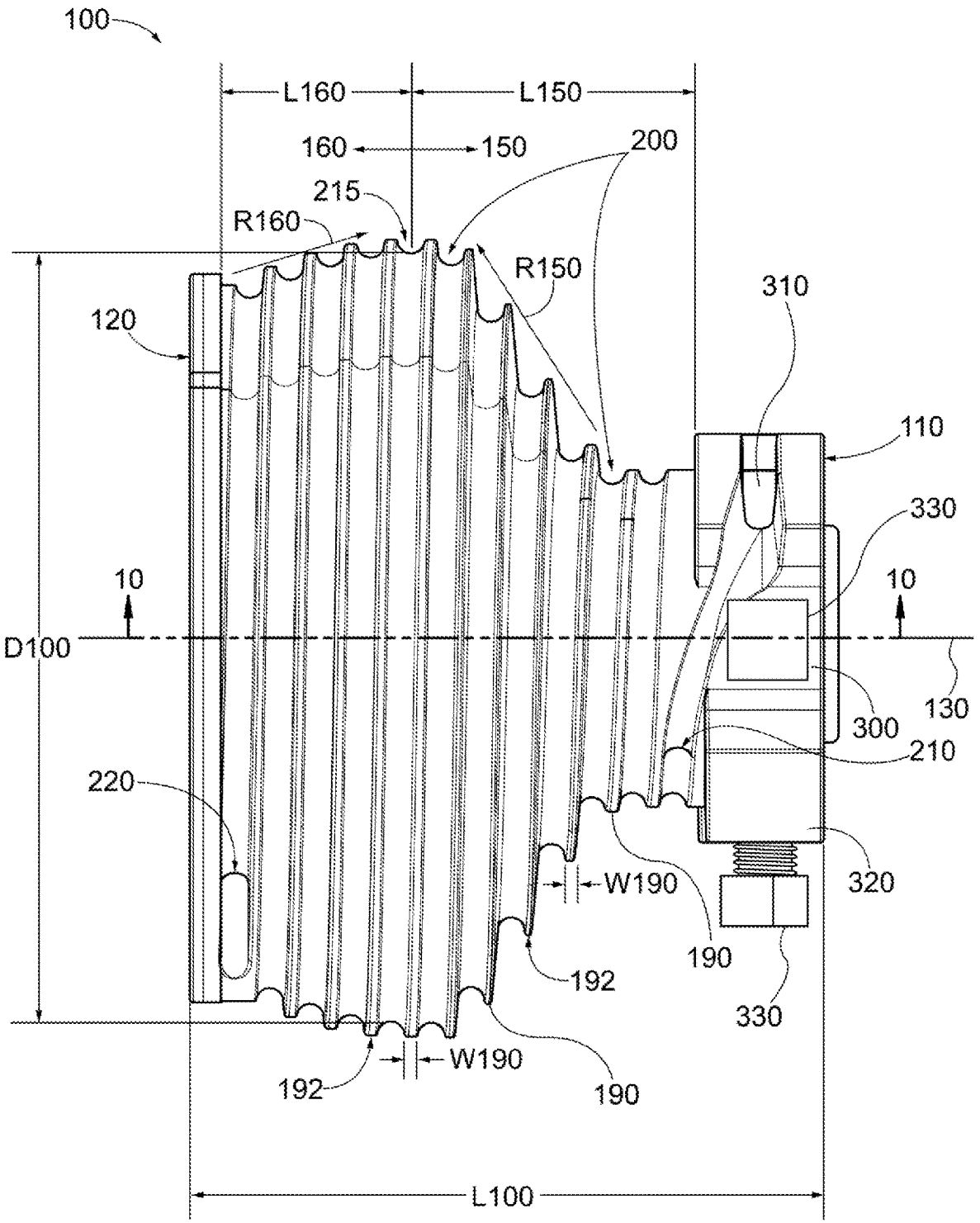
FIG. 5 is side view of a drive drum, in accordance with an example of the disclosure.

Turning now to FIG. 5, a drive drum 100 of the present disclosure is illustrated. The drive drum 100 comprises a cable groove 200. The cable groove 200 has a first cable groove end 210 and a second cable groove end 220 such that the cable groove 200 winds about a perimeter of the drive drum 100 helically in a direction of the axis 130 of the drive drum 100. The cable groove 200 winds about a perimeter of the drive drum helically from the first cable groove end 210 to the second cable groove end 220. The drive drum 100 further comprises a drive drum diameter $D_{100}$ which varies between a first end 110 of the drive drum 100 and a second end 120 of the drive drum 100 where the first end 110 of the drive drum 100 is situated adjacent the first cable groove end 210. As used herein, the drive drum diameter is as measured from the base of the cable groove between each respective cable groove position along the length of the drive drum $L_{100}$. The second end 120 of the drive drum 100 is situated adjacent the second cable groove end 220. In one example of the present disclosure, the drive drum diameter at an intermediate cable groove position 215, between the first cable groove end 210 and the second cable groove end 220 is greater than the diameter of the drive drum $D_{100}$ at either the first cable groove end and the diameter of the drive drum at the second cable groove end. In some examples, the intermediate cable groove position 215 may have the greatest drive drum diameter $D_{100}$. In some examples, the drive drum diameter $D_{100}$ continuously increases from the first cable groove end 210 to the intermediate cable groove position 215. In some examples, the drive drum diameter $D_{100}$ continuously increases from the second cable groove end 220 to the intermediate cable groove position 215. Further, the drive drum diameter $D_{100}$ may continuously increase from the first cable groove end 210 to the intermediate position 215 and continuously decrease from the intermediate cable groove position 215 to the second cable groove end 220.

To compensate for the non-linearity of energy exerted by the counter-balancing system and/or the overhead door arrangement, the drive drum diameter is additionally non-linear. More specifically, the drive drum may be non-linear in a graduated manner from the first cable groove end to the intermediate cable groove position. Additionally, or alternatively, the drive drum may be non-linear in a graduated manner from the second cable groove end to the intermediate cable groove position. In some specific examples, the drive drum comprises two separate non-linearly graduated sections, as defined by the drive drum diameter. More specifically, the drive drum may comprise two separate opposing non-linear graduated sections, as defined by the drive drum diameter.

Still referring to FIG. 5, the diameter $D_{100}$ of the drive drum 100 increases toward the intermediate cable groove position from the first cable groove end 210 by increasing the diameter drive drum 100 as the helical cable groove 200 travels in a direction of the drive drum axis 130 toward the intermediate position. Upon reaching the intermediate position, the diameter of the drive drum 100 decreases from the intermediate position toward the second cable groove end 220 by decreasing the diameter of the drive drum 100 as the helical cable groove 200 travels in a direction of the drive drum axis 130 toward the second cable groove end 220. As the diameter of the drive drum 100 increases from the first cable groove end 210, the cable groove 200 makes non-linear graduated steps, as measured from the base of the cable groove 200, along a path parallel to the direction of the drive drum axis 130. Additionally, or alternatively, as the diameter $D_{100}$ of the drive drum 100 decreases from the intermediate position to the second cable groove end 220 the cable groove 200 makes non-linear reverse-graduated steps (in the decreasing direction), as measured from the base of the cable groove 200, along a path parallel to the direction of the drive drum axis 130. In some specific examples, the non-linear graduated, or reverse-graduated, steps include at least two or more continuous steps. In other examples, the non-linear graduated, or reverse-graduated, steps include at least three or more continuous steps. Still, in another example, the non-linear graduated, or reverse graduated, steps include at least four or more continuous steps.

In view of the above, the drive drum 100 of the present disclosure comprises two opposing sections, a first section 150 and a second section 160. In some examples, the drive drum only has a first section 150 and a second section 160. Both the first section 150 and the second section 160 of the drive drum 100 rise, or increase in diameter $D_{100}$, from their respective ends and intersect at the intermediate position. The rise in each respective section may be continuous. The cable groove 200 as described above follows this drive drum 100 arrangement and is also continuous through the first section 150 and the second section 160. In other words, the spring cable 26 (as illustrated by FIGS. 2-3) positioned within the cable groove 200 may continue across both sections 150, 160. The first section 150 and the second section 160 may rise at the same non-linear rate from their respective ends in the manner described above (e.g. opposing non-linear graduated sections). In other examples, the first section 150 and the second section 160 may rise at different non-linear rates from their respective ends in the manner described above (e.g. opposing non-linear graduated sections). Although the two sections are opposing sections, the first section 150 and the second section 160 may comprise different lengths $L_{150}$, $L_{160}$ extending in a direction of the axis 130 of the drive drum 100. In one example, the first section 150 is shorter than the second section 160. In yet another example, the first section 150 may be longer than the second section 160. Further, the rise of the first section $R_{150}$, in a direction of the intermediate position, may be at a much higher rate than the rise of the section $R_{160}$, in a direction of the intermediate position. In one specific example, the rise of the first section $R_{150}$ is at a much higher rate than the opposing rise of the second section $R_{160}$ and the first section 150 comprises a diameter $D_{100}$ at the first cable groove end 210 that is less than a diameter $D_{100}$ at the second cable groove end 220 of the second section 160.

In one example, an entire operating assembly for an overhead door may include a drive drum operating between a rotating shaft and a counter-balancing system. The drive drum controls movement of the overhead door in combination with the counter-balancing system which assists with the movement of the overhead door. The drive drum may comprise two opposing graduated sections as measured from a base of the cable groove. The cable groove extends about a perimeter of the drive drum in a helical manner from a first cable groove end to a second cable groove end in a direction of an axis of the drive drum. The graduation of the first graduated section increases toward the second graduated section. The graduation of the second graduated section increases toward the first graduated section. The first graduated section and the second graduated section may meet at an intermediate position where the cable groove is continuous from the first graduated section into the second graduated section through the intermediate position. In specific examples, either or both of the graduated section comprise non-linear graduations. Further, either or both of the graduated sections may consist entirely of non-linear graduations or steps, or only have non-linear graduations or steps.

Figure 6:
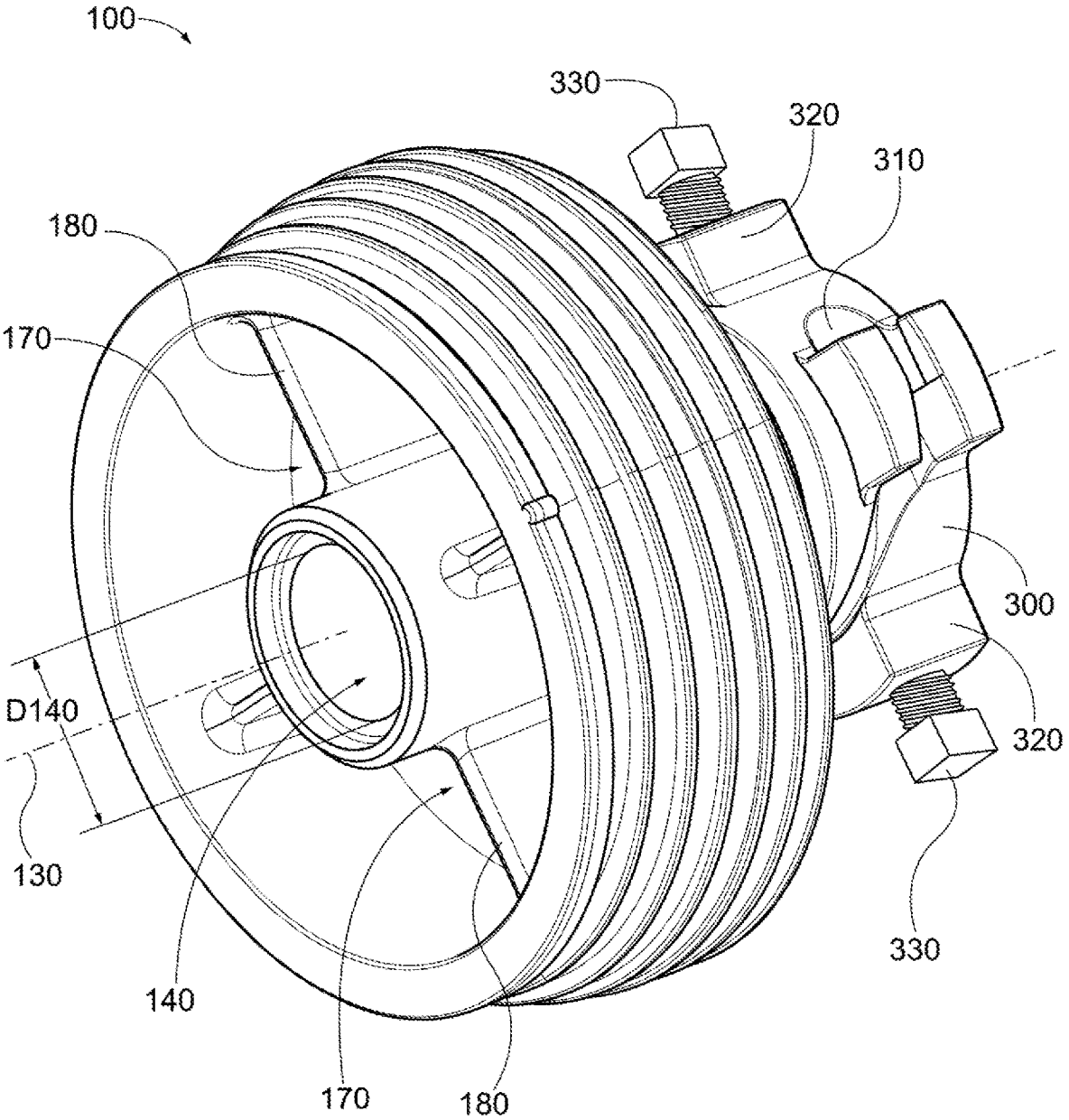
FIG. 6 is a perspective view of a drive drum, in accordance with an example of the disclosure.
Figure 7:
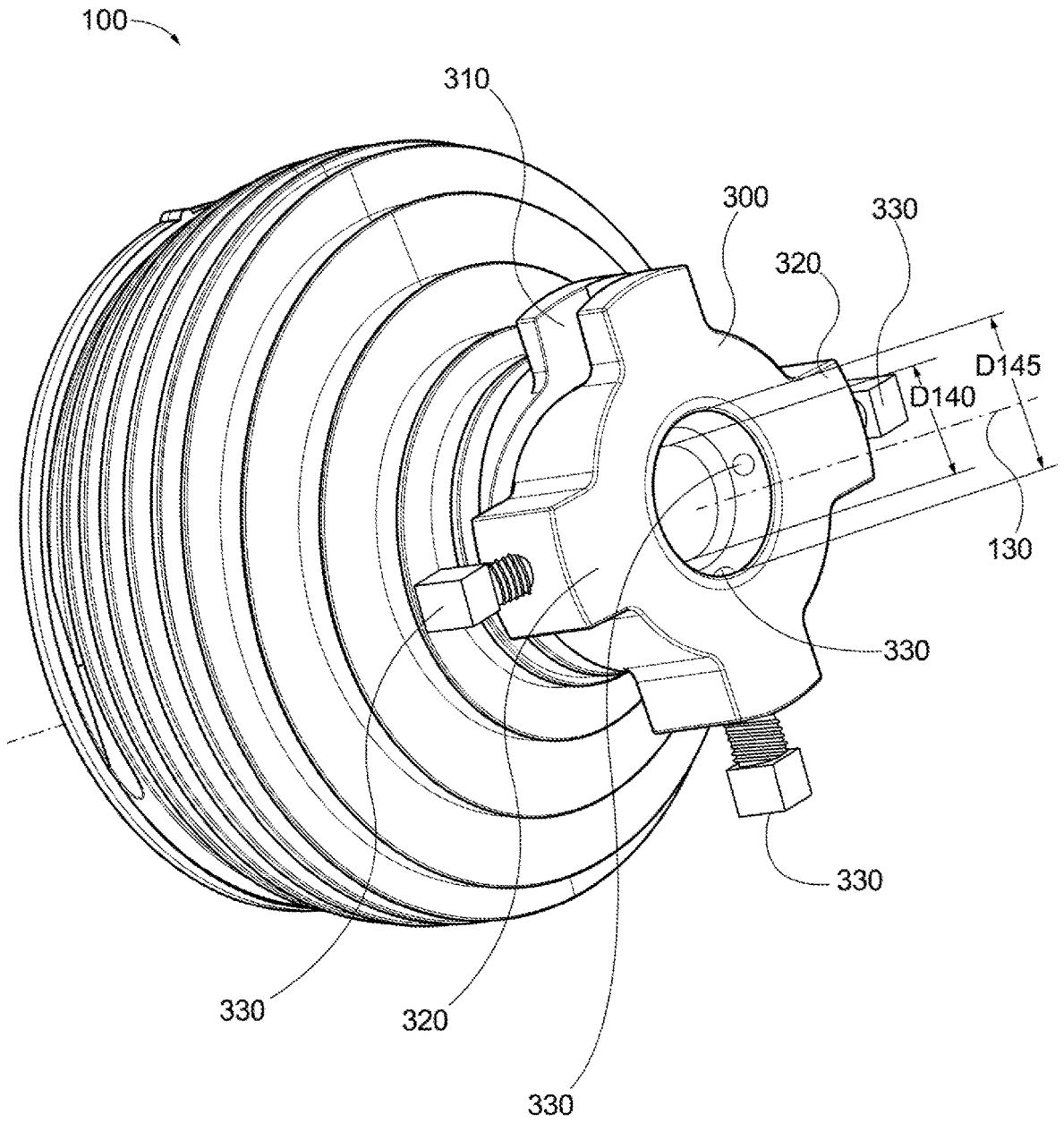
FIG. 7 is a perspective view of a drive drum, in accordance with an example of the disclosure.
Figure 8:
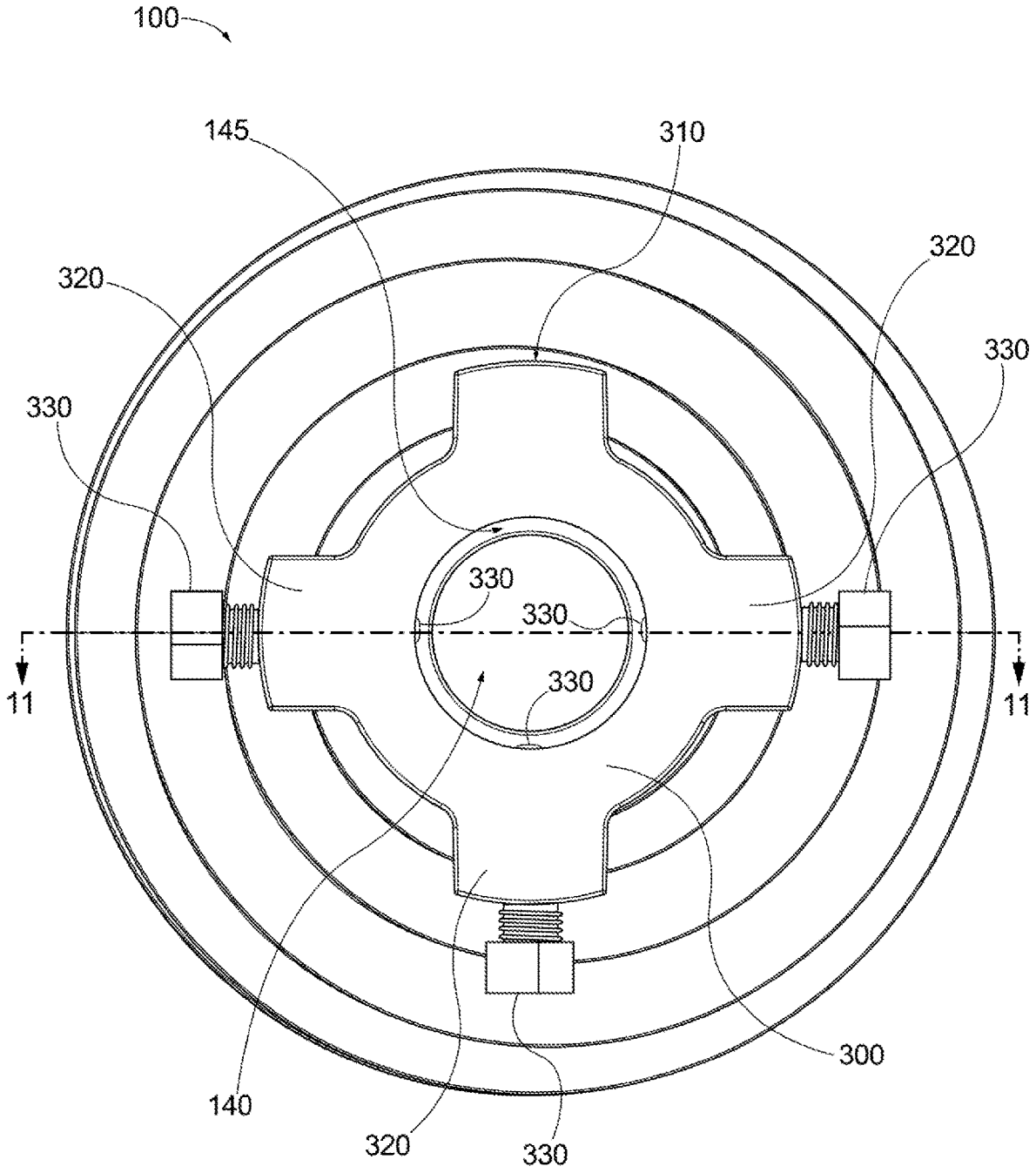
FIG. 8 is a first end view of a drive drum, in accordance with an example of the disclosure.
Figure 9:
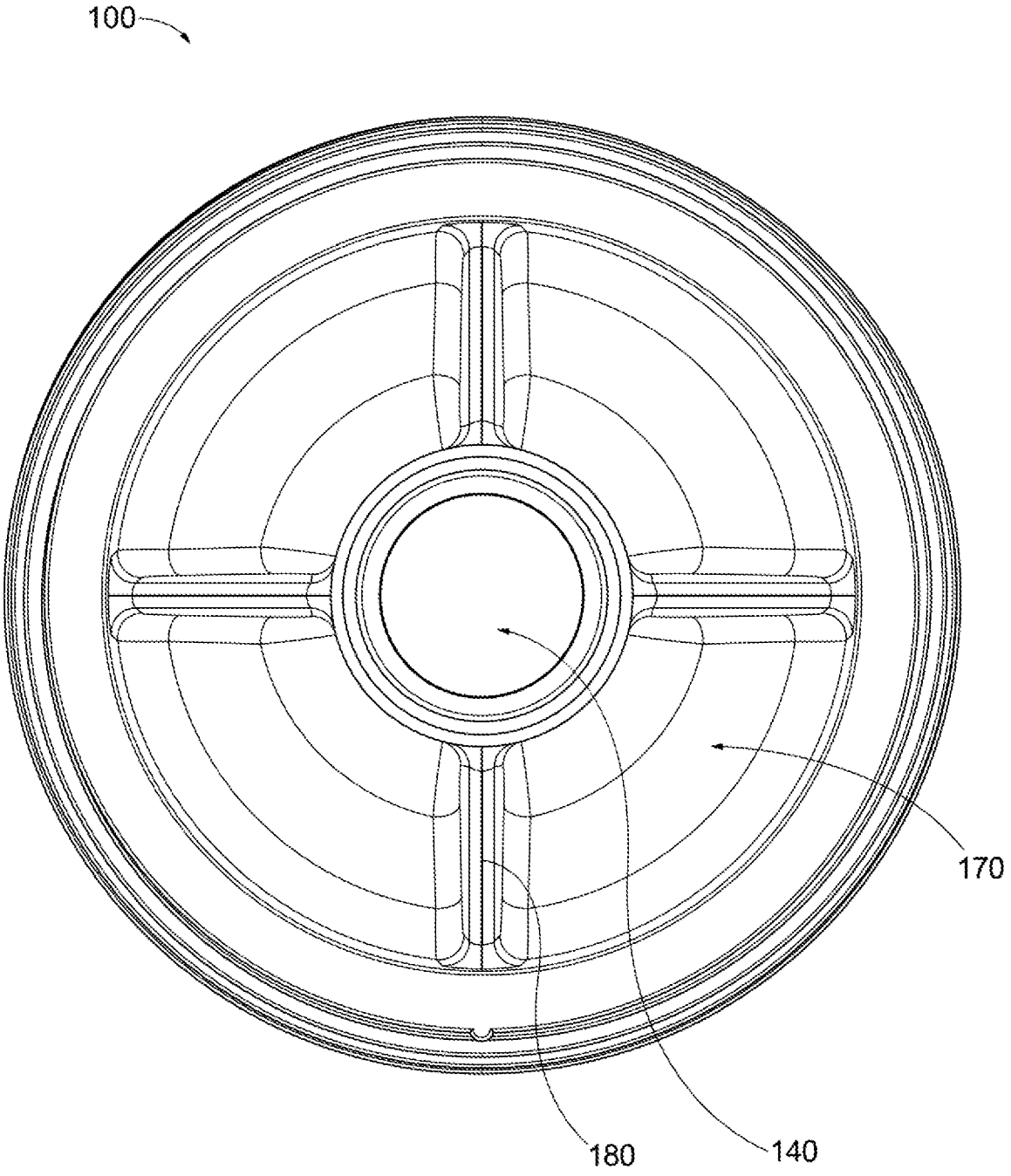
FIG. 9 is a second end view of a drive drum, in accordance with an example of the disclosure.
Figure 10:
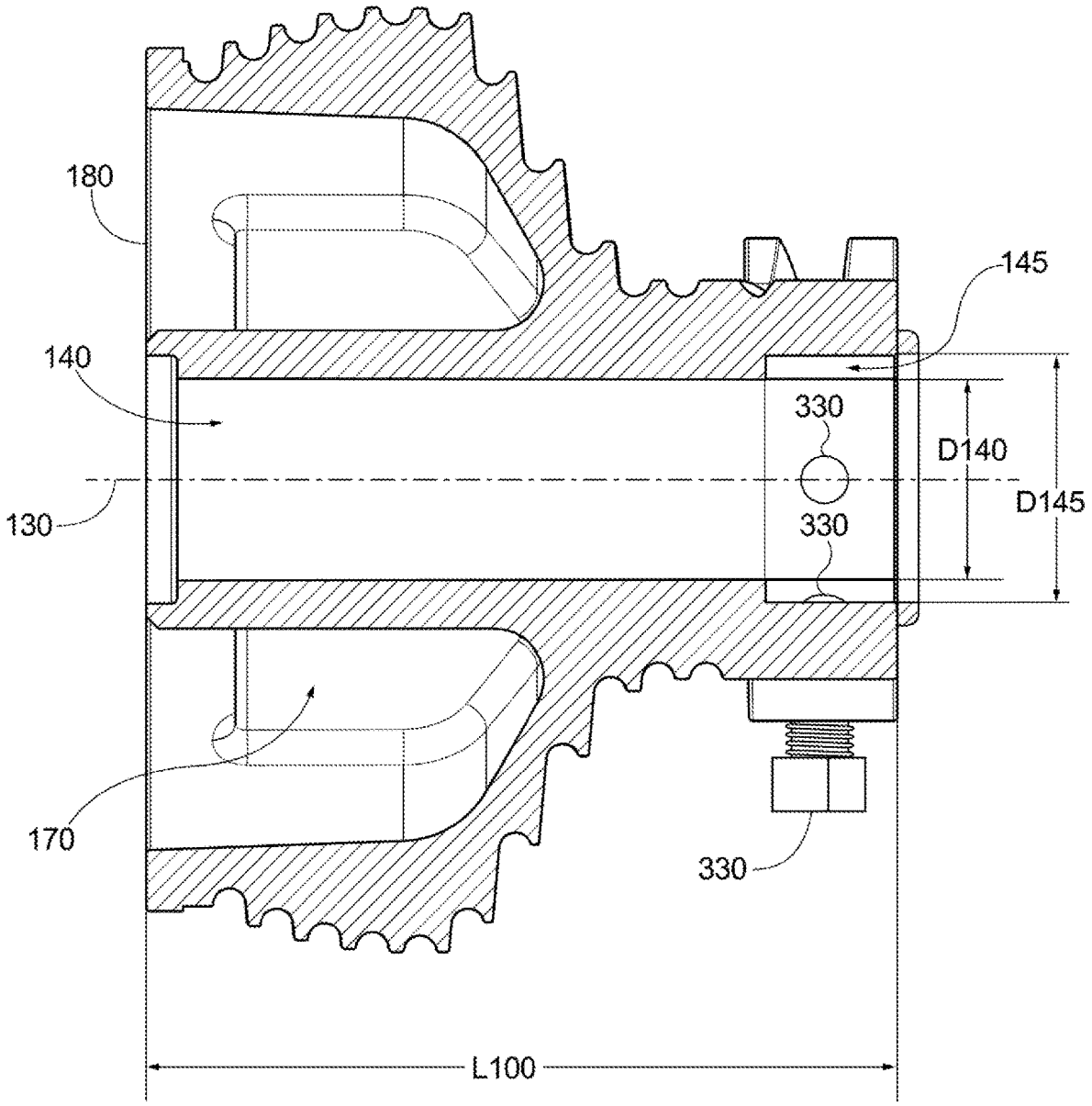
FIG. 10 is a cross-section of a drive drum taken at line 10-10 of FIG. 5.
Figure 11:
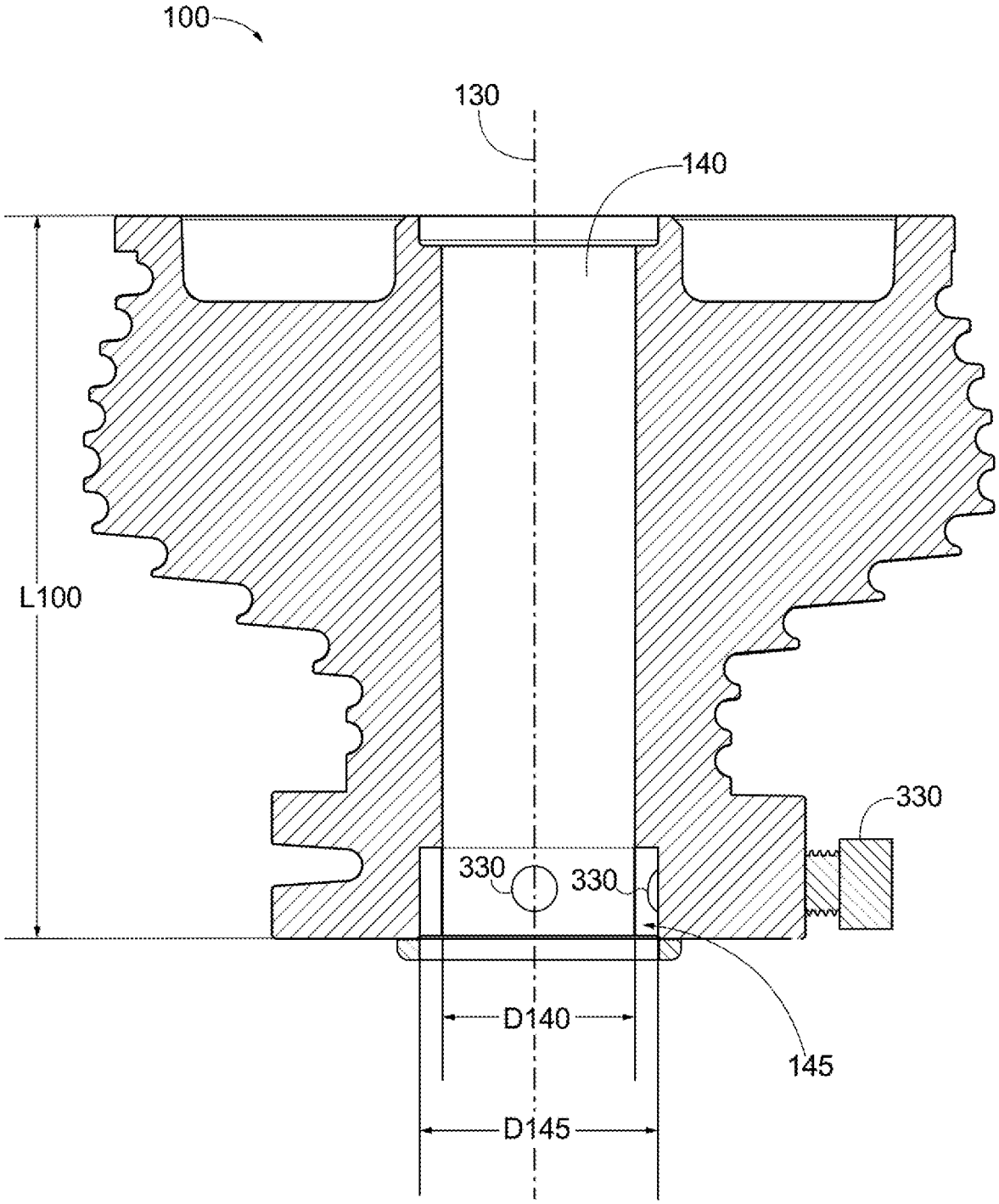
FIG. 11 is a cross-section of a drive drum taken at line 11-11 of FIG. 8.

As illustrated by FIGS. 6-11, the drive drum includes a center bore 140 for receiving the shaft 16 (as illustrated by FIGS. 1-3). As illustrated by the cross-sections of FIGS. 10-11, the center bore 140 extends the entire length $L_{100}$ of the drive drum 100 along the axis 130 of the drive drum 100. In the present example, as illustrated by FIGS. 5-11, the drive drum 100 is a die casting. Other methods of manufacture are contemplated herein. As illustrated by FIGS. 6 and 9-10, the drive drum may be formed or manufactured with one or more voids 170. The voids 170 may be provided to reduce the weight of the drive drum 100 and/or to reduce material usage in a single drive drum. Structural members 180 may also be provided in the voids 170 to strengthen the structure of the die cast.

As illustrated by FIGS. 5-8 and 10-11, the drive drum 100 may also comprise a hub 300. The first end 210 of the cable groove 200 may be positioned on the hub 300 for anchoring the spring cable 26 (as illustrated by FIGS. 2-3) to the drive drum 100 at the hub 300. In the present example, the cable groove 200 extends onto the hub 300 where an end of the spring cable 26 is anchored on the hub 300 at a cable groove anchor 310. The hub 300 may further comprise one or more lugs 320. In the present example, the hub 300 comprises three lugs 320 where two lugs are opposite one another, relative to the drive drum axis 130, and the third lug is opposite the cable groove anchor 310, relative to the drive drum axis 130. Each respective lug 320 comprises a set screw 330 for anchoring or adjusting the drive drum 100 on the shaft 16 (as illustrated by FIGS. 1-3). Each respective set screw 330 extends through the lug 320 and may advance into the shaft 16 at the bore 140 for securing the drive drum 100 to the shaft 166. In this particular example, the lugs 320 and the set screws 330 are in a threaded arrangement.

In one specific example, the drive drum 100 further comprises a counterbore 145. The counterbore 145 is positioned at a first end 110 of the drive drum 100 and increases the diameter $D_{140}$ of the drive drum bore 140 to a counterbore diameter $D_{145}$. As illustrated by FIG. 10, the counterbore is positioned in the hub 300 and each respective set screw 330 extends through the counterbore 145. The counterbore 145 allows the drive drum 100 to rotate about the shaft 16 (as illustrated by FIGS. 1-3) for minor adjustment. More specifically, the counterbore 145 allows the drive drum 100 to rotate about the shaft 16 (as illustrated by FIGS. 1-3) for minor adjustment after initial use or after having been secured to the shaft 16 (as illustrated by FIGS. 1-3). The counterbore 145 of the present drive drum 100 provides a void between the exterior diameter of the shaft and the bore diameter $D_{140}$ of the drive drum 100. When a set screw 330 is tightened onto a shaft 16 (as illustrated by FIGS. 1-3), the shaft 16 may become scarred or marred by the set screw 330. This scar, or imperfection, now present on the shaft, makes it difficult to rotate or move the drive drum 100 about the shaft 16 which has an outside diameter that is constructed within tight tolerances to the bore diameter $D_{140}$ of the drive drum 100. The scar, or imperfection, binds the drive drum 100 onto the shaft 16, thereby, preventing fine adjustment or rotation between the drive drum 100 and the shaft 16. By providing a counterbore 145 at each respective set screw 330 location, regardless of whether the set screw 330 had previously scarred the shaft 16, the drive drum 100 may freely rotate about the shaft 16 without binding on any scars or imperfections previously formed on the shaft 16 by the set screws 330. The importance of this fine adjustment will be discussed in greater detail below.

Figure 12:
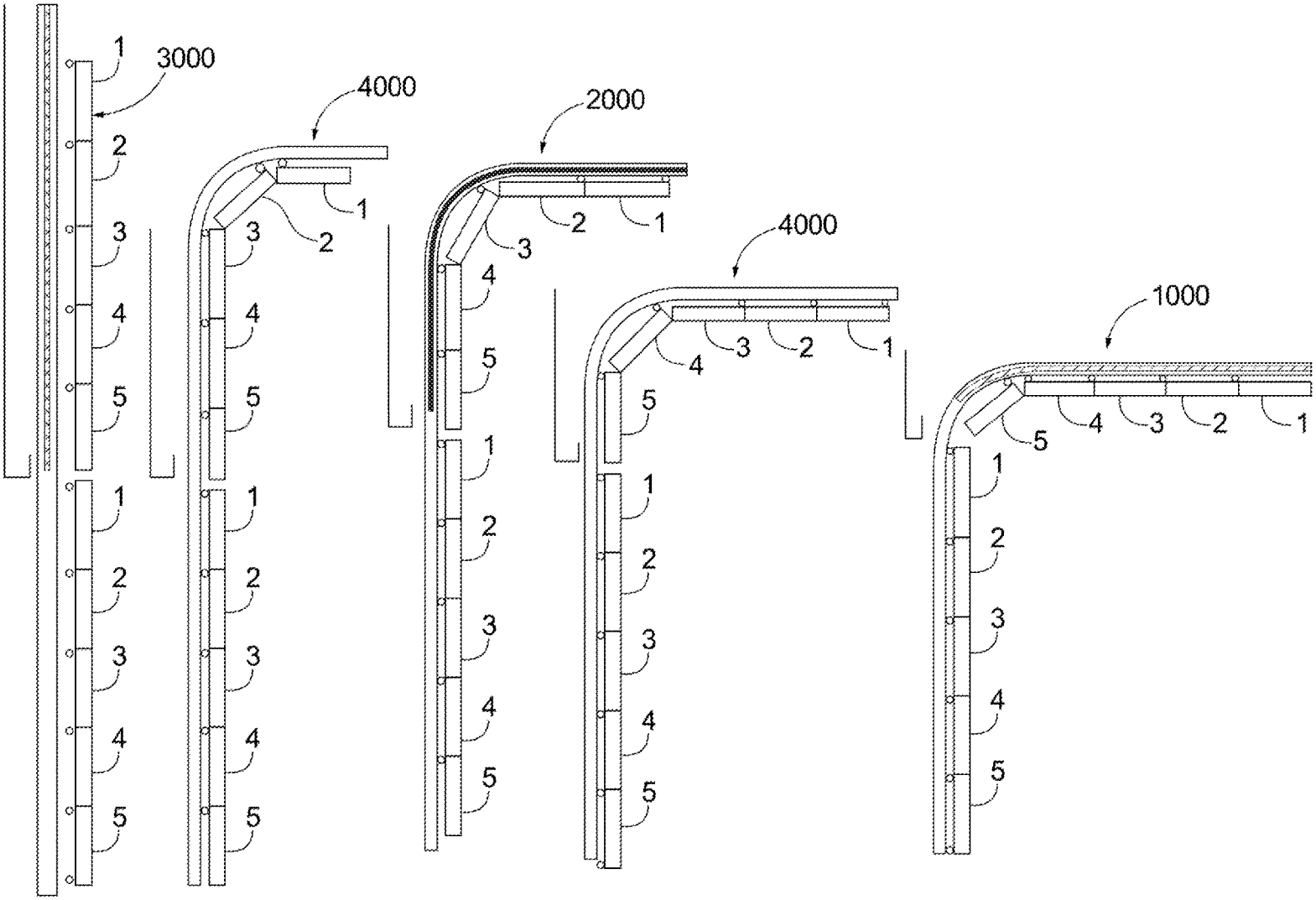
FIG. 12 illustrates examples of overhead doors across the families of the standard lift door, the high lift door, and the vertical lift door, in accordance with examples of the disclosure.

As mentioned above, the drive drum of the present disclosure provides the flexibility of being used across various types of overhead doors, or families of overhead doors, including standard lift doors, vertical lift doors, and high lift doors. The drive drum may additionally provide the flexibility of being used across various types of drive drums in combination with the various types of overhead doors. Examples of the various types of overhead doors are illustrated in FIG. 12 with variations additionally illustrated therebetween. Specifically, a standard lift door arrangement 1000, a high lift door arrangement 2000, and a vertical lift door arrangement 3000 are illustrated. Each door arrangement further illustrates door panels as numbered 1-5. The door panel numbering to the right of each orientation reflects the door panels location in the open position and the panel numbering to the left of each orientation reflects the door panel location in the closed position. Also, as illustrated by FIG. 12, additional arrangements 4000 are illustrated between each respective standard 1000, high 2000, and vertical 3000 arrangements. This is representative of the various door configurations the drive drum of the present disclosure may additionally be compatible with. Specifically, the compatibility of the drum is not limited to the standard lift, high lift, and/or vertical lift arrangements, alone. As noted above, this may generally be referred to as being compatible across the family of each the standard lift, high lift and vertical lift arrangements. Moreover, the drive drum may be compatible with additional variations of overhead doors such as those which may follow a curvature and/or angle of a wall or ceiling. In some examples the drive drum of the present disclosure may be for use with overhead doors, generally, or one or more of each or all of a standard lift door, a vertical lift door, and/or a high lift door. In yet other examples, the drive drum of the present disclosure may be interchangeable across one or more of each or all of a standard lift door, a vertical lift door, and/or a high lift door. The two graduated sections, as described above, provide this increased flexibility for use.

Figure 13:
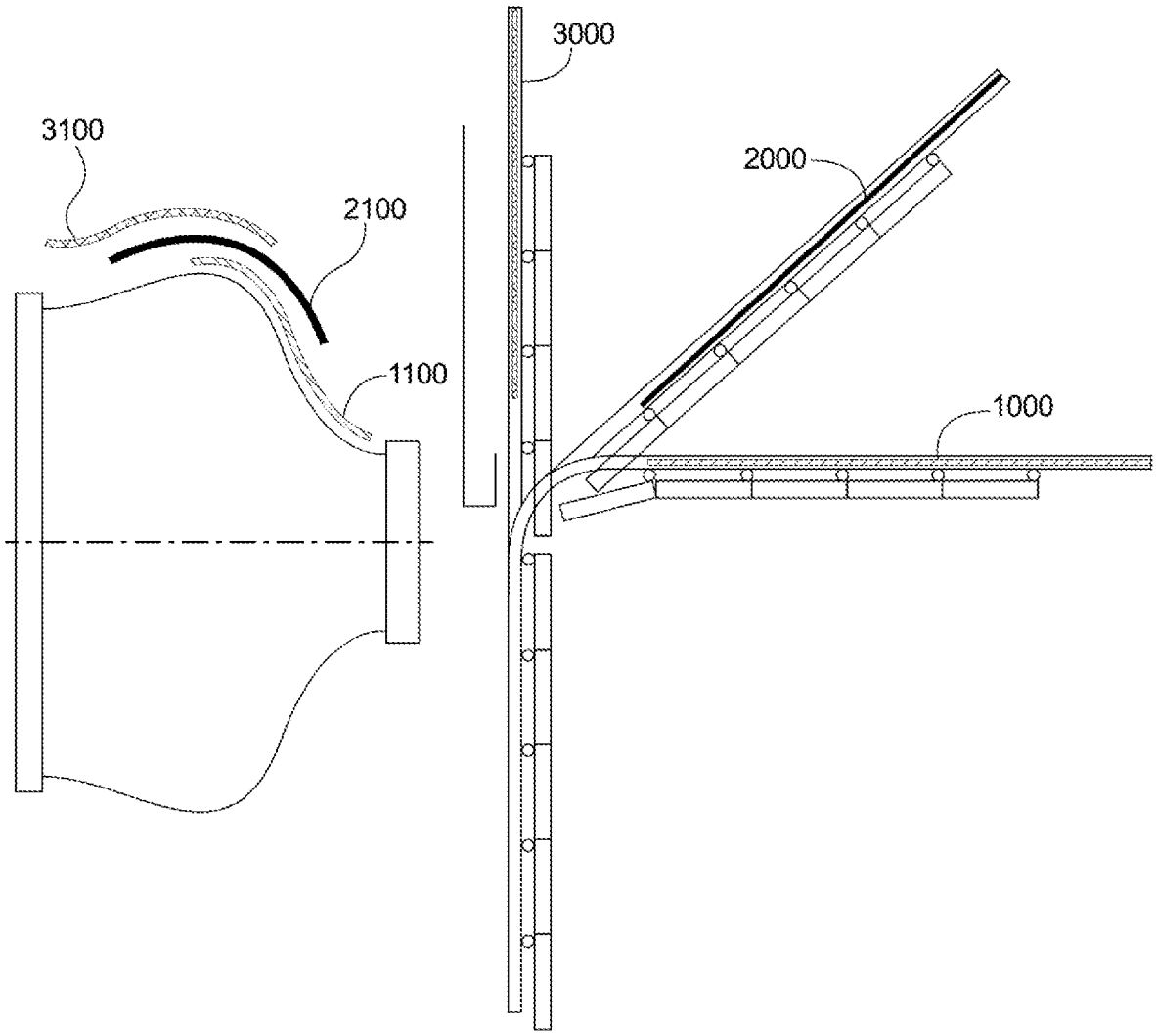
FIG. 13 illustrates the spring cables utilization of the drive drum of the present disclosure across the families of the standard lift door, the high lift door, and the vertical lift door, in accordance with examples of the disclosure.

Turning now to FIG. 13, each of the standard lift arrangement 1000, a roof line arrangement 2000, and the vertical lift arrangement 3000 are illustrated in a single illustration. In this figure a roof line arrangement is being illustrated as yet another example of a variation of a door configuration. The roof line arrangement is used in alternative to the high lift of FIG. 12 but only as an illustration of yet another configuration. In the adjacent illustration a drive drum of the present disclosure is also illustrated. The drive drum is labeled to illustrate a spring cable's utilization of the drive drum by way of each respective arrangement. Specifically, 1100 illustrates the spring cable's utilization of the drive drum for a standard lift arrangement, 2100 illustrates the spring cable's utilization of the drive drum for a high lift arrangement, and 3100 illustrates the spring cable's utilization of the drive drum for a vertical lift arrangement. As an alternative to the roof line the cables utilization of the drum at 2100 additionally may correspond to the high lift arrangement as illustrated by FIG. 12. Spring cable utilization of the drive drum as relied on herein refers to the area that the spring cable operates on the drive drum (e.g. winds onto and unwinds from the drive drum) for a complete operation of an overhead door, such as from an open position to a closed position or vice versa. The drive drum may further comprise additional windings of spring cable about the drive drum wherein the additional windings simply are not utilized on the drive drum (e.g. winds onto and unwinds from the drive drum) between the open position and the closed position. Instead, the additional windings remain wound about the drive drum regardless of the position of the overhead door between the open position and the closed position. These respective arrangements are accordingly described below.

When used on a standard lift door only the first section or a partial section of the first section of the drive drum may be utilized by a spring cable. This is possible since a standard lift door evenly transitions from a full vertical position to a full horizontal position, a substantially full horizontal position, or a primarily full horizontal position. Substantially full horizontal position, as used herein, means a majority of a door is positioned on the horizontal section of the track with at least a partial section of the door positioned on the transition section of the track. Primarily full horizontal position, as used herein, means a majority of the door is positioned the horizontal section of the track and the transition section of the track and, at least, a partial section of the door remaining on the vertical section of the track. Since the standard lift door receives additional assistance to maintain the overhead door in the open position, by having the weight of the door supported in the horizontal section of the track, it is not necessary to compensate for increased energy by further extending the cable across multiple sections of the drive drum.

When used on a vertical lift door the entire second section, alone, or the entire second section and at least a partial first section may be utilized by a spring cable. In some instances, a vertical lift door may utilize a partial second section or a partial second section and a partial first section. In contrast to the standard lift door, a vertical lift door maintains the door in a vertical, or a substantially vertical, arrangement. As used herein substantially vertical means the entire door is maintained in a direction within 30 degrees of the vertical direction. Thereby, the drive drum and the counter-balancing system must work in unison to support the vertical lift door and maintain the vertical lift door in an opened position without gaining too much force between the closed position and the open position. Vice versa, the drive drum and the counter-balancing system must also work in unison to provide resistance to closing the door from the open positioned and offsetting the force of the door when approaching the closed position. This balancing of forces is accomplished by utilizing at least one of the two opposing graduated sections, and in some instance both of the opposing graduated sections, of the drive drum and adjusting the force applied by way of the counter-balancing system through the respective diameters of each respective graduated sections of the drive drum.

When used on a high lift door only a partial section of the first section and a partial section of the second section of the drive drum may be utilized by the spring cable. The high lift door, as described above, requires an increased amount of vertical lift as compared to a standard lift door but additionally encounters a non-vertical section of a track, in contrast to the vertical lift door. In one example of a high lift configuration, the spring cable is secured at an intermediate location of the first section of the drive drum and extends to an intermediate location of the second section of the drive drum for the full travel of the high lift door. Depending upon how much horizontal track section the high lift door may have, one example of a high lift door may have a cable extending only a partial section of the first section (or extend from an intermediate location of the first section) and extend at least a partial section for the full travel of the high lift door.

Below are some examples of a cable operating on different sections or partial sections of the drive drum based upon the type of or orientation of the overhead door. In some examples the cable may operate within the cable groove on the first graduated section only, between the open position and the closed position of the overhead door. In some examples the cable may operate within the cable groove on both the first graduated section and the second graduated section, between the open position and the closed position of the overhead door. In some examples the cable may operate within the cable groove less than 75% of both the first graduated section and the second graduated section, between the open position and the closed position. In some examples the cable may operate within the cable groove less than 75% of at least one of the first graduated section and the second graduated section, between the open position and the closed position. In some examples the cable may operate within the cable groove less than 50% of both the first graduated section and the second graduated section, between the open position and the closed position. In some examples the cable may operate within the cable groove less than 50% of at least one of the first graduated section and the second graduated section, between the open position and the closed position. In some examples the cable may operate within the cable groove less than 25% of both the first graduated section and the second graduated section, between the open position and the closed position. In some examples the cable may operate within the cable groove less than 25% of at least one of the first graduated section and the second graduated section, between the open position and the closed position. In some examples the cable groove may operate within the cable groove 100% of at least one of the first graduated section and the second graduated section, between the open position and the closed position. In some examples the cable groove may operate within the cable groove 100% of the second graduated section, between the open position and the closed position.

As illustrated by each of the examples above, the drive drum of the present disclosure may be used across each of a standard lift door, a vertical lift door, and a high lift door or the respective families of each arrangement. It is also appreciated herein that each standard lift doors, vertical lift doors, and high lift doors, respectively, are not built alike. Therefore, there remains a degree of adjustability that must be maintained at the drive drum to dial in the most efficient and balanced door travel for each arrangement. This is accomplished by providing flexibility in where the cable may be secured to each respective section of the drive drum. As noted above, the cable may be secured at an intermediate point of the first section and may travel on only the first section, both the first section and the second section, partially the first section and the second section, or the like. Further, the drive drum also includes a fine tune adjustment wherein the drive drum includes the above mentioned counterbore which allows the drive drum to be rotated about or be moved along the shaft without interference from scars or imperfections that may arise on the shaft as a result of prior use of the set screws. In other words, it may be said that the drive drum may be adjusted by way of rotating the drive drum independent of the shaft without interference from any scars or imperfections produced by the set screws. Thereby, the location of the spring cable is adjustable about the diameter of the drive drum relative the counter-balancing system.

In some examples the drive drum may be manufactured by way of die casting. In the die casting process, draft is required to be maintained on each of the surfaces for ejection of the casting from the die. Due to the non-linear graduations it is necessary to rely on a variable draft across the drive drum when relying on this manufacturing process. As a result, each respective cable groove may additionally vary at each respective sidewall 190, or at the sidewalls separating each respective cable groove graduation, as it progresses the non-linear graduation and as illustrated by FIG. 5. In one specific example, the width $W_{190}$ of one or more of the sidewalls 190, as measured at the ridge 192, or lip, of the sidewall 190, is smaller on the first section 150 than the width of a sidewall $W_{190}$ of the second section 160. In another example, the average width of the sidewalls 190 of the first section 150 is less than the average width of the sidewalls $W_{190}$ of the second section 160. In still yet another example, the width of the sidewalls $W_{190}$ may further vary on each respective section 150, 160. In such an example, the width of the sidewall $W_{190}$ between each respective cable groove graduation increases as the rate of graduation decreases or, alternatively, decreases as the rate of graduation increases.

In some examples, the sidewalls may additionally vary based upon the pitch of the graduations. In one example, a constant pitch is maintained between each cable groove graduation. In other examples, a variable pitch may be provided between one or more cable groove graduations. As used herein, pitch is the distance between each cable groove, as measured from the base of the cable groove, in the direction of the axis of the drive drum. In some examples, the pitch across the first cable groove section may be the same as the pitch across the second cable groove section. In some examples, the pitch of the first cable groove section may be constant while the pitch of the second cable groove may be variable, or vice versa. In some examples, the pitch may be constant through the first cable groove section and the second cable groove section. In some examples, the pitch may be variable though the first cable groove section and the second cable groove section. The pitch may additionally vary between a constant and a variable pitch on each cable groove section in the examples above. The pitch may additional correspond to the width of the sidewall. By example, if a constant pitch is maintained but the non-linear graduations vary the depth of the cable groove may increase as the step of the graduation increases. Therefore, the width of the sidewall may correspondingly decrease in order to maintain the constant pitch. In other examples, the pitch may be variable in order to maintain a constant sidewall dimension across the non-linear graduations.

While this invention has been described with reference to examples thereof, it shall be understood that such description is by way of illustration only and should not be construed as limiting the scope of the claimed examples. Accordingly, the scope and content of the examples are to be defined only by the terms of the following claims. Furthermore, it is understood that the features of any example discussed herein may be combined with one or more features of any one or more examples otherwise discussed or contemplated herein unless otherwise stated.

What is claimed is:

1. An operating assembly for an overhead door comprising:

a drive drum operating between a rotating shaft, for controlling movement of an overhead door, and a counter-balancing system, to assist with the movement of the overhead door;

wherein the drive drum further comprises two opposing graduated sections of a cable groove extending about a perimeter of the drive drum in a direction of an axis of the drive drum;

wherein a graduation of the first graduated section of the two opposing graduated sections increases toward a second graduated section of the two opposing graduated sections;

wherein a graduation of the second graduated section increases toward the first graduated section; and wherein at least one of the two opposing graduated sections is additionally non-linear.

2. The operating assembly of claim 1 wherein the first graduated section and the second graduated section are defined by at least three consecutive graduations extending in the direction parallel to the axis of the drive drum.

3. The operating assembly of claim 1 wherein the first graduated section and the second graduated section are defined by at least four consecutive graduations extending in the direction parallel to the axis of the drive drum.

4. The operating assembly of claim 1 wherein the two opposing graduated sections are adjacent.

5. The operating assembly of claim 4 wherein the two opposing graduated sections meet at the largest drive drum diameter.

6. The operating assembly of claim 1 wherein an intermediate section separates the two opposing graduated sections.

7. The operating assembly of claim 6 wherein the intermediate section comprises the largest drive drum diameter.

8. The operating assembly of claim 1 wherein the dimension between each respective graduation of the non-linear graduated section increases toward the opposing graduated section.

9. The operating assembly of claim 1 wherein the drive drum further comprises:

a hub where the hub includes one or more set screws extending therethrough for anchoring the drive drum to the shaft; and a bore having a bore diameter which mates with an exterior diameter of the shaft and a counterbore through which a set screw extends wherein a counterbore diameter is greater than the bore diameter.

10. The operating assembly of claim 1 wherein a cable operates within the cable groove on the first graduated section only between an open position and a closed position.

11. The operating assembly of claim 1 wherein a cable operates within the cable groove on both the first graduated section and the second graduated section between an open position and a closed position.

12. The operating assembly of claim 11 wherein the cable operates within the cable groove less than 75% of both the first graduated section and the second graduated section.

13. The operating assembly of claim 11 wherein the cable operates within the cable groove less than 75% of at least one of the first graduated section and the second graduated section.

14. The operating assembly of claim 11 wherein the cable operates within the cable groove less than 50% of at least one of the first graduated section and the second graduated section.

15. The operating assembly of claim 14 wherein the cable operates within the cable groove less than 50% of at least the first graduated section.

16. The operating assembly of claim 11 wherein the cable operates within the cable groove less than 25% of at least one of the first graduated section and the second graduated section.

17. The operating assembly of claim 16 wherein the cable operates within the cable groove less than 25% of the first graduated section.

18. The operating assembly of claim 11 wherein the cable operates within the cable groove 100% of at least one of the first graduated section and the second graduated section.

19. The operating assembly of claim 18 wherein the cable operates within the cable groove 100% of the second graduated section.

* * * * *